313-414
9/17/85 OR 4,542,318

United States Patent [19]
Say

[11] Patent Number: 4,542,318
[45] Date of Patent: Sep. 17, 1985

[54] CRT LENSING ELECTRODES HAVING APERTURES DEFINED BY TAPERED SIDEWALLS

[75] Inventor: Donald L. Say, Waterloo, N.Y.

[73] Assignee: North American Philips Consumer Electronics Corp., New York, N.Y.

[21] Appl. No.: 463,791

[22] Filed: Feb. 4, 1983

Related U.S. Application Data

[63] Continuation-in-part of Ser. No. 450,574, Dec. 16, 1982, abandoned.

[51] Int. Cl.[4] ..... H01J 29/62
[52] U.S. Cl. ..... 313/414
[58] Field of Search ..... 313/414

[56] References Cited

U.S. PATENT DOCUMENTS 4,275,332 6/1981 Ashizaki et al. ..... 313/414
4,358,703 11/1982 Bijma et al. ..... 313/448
4,412,149 10/1983 Say ..... 313/414

FOREIGN PATENT DOCUMENTS 63062 5/1977 Japan ..... 313/414
82549 7/1981 Japan ..... 313/414
44655 3/1983 Japan ..... 313/414

*Primary Examiner*—Palmer C. DeMeo
*Attorney, Agent, or Firm*—John C. Fox

[57] ABSTRACT

The invention pertains to the achievement of improved lensing means employed in compact plural beam in-line CRT electron gun assemblies resulting in small round spot sizes on the screen. Such is effected by forming cooperating tapered apertures in a low potential lensing electrode and similar facing apertures in an adjacent high potential lensing electrode. The larger openings of the two sets of facing tapered apertures provide lenses of larger than normal dimensions. Additionally, partial overlapping of the apertures permits even larger lenses in the available electrode areas, thereby effecting further improved lensing of the beams.

24 Claims, 14 Drawing Figures

CRT LENSING ELECTRODES HAVING APERTURES DEFINED BY TAPERED SIDEWALLS

CROSS-REFERENCE TO RELATED APPLICATION

This application is a continuation-in-part of Ser. No. 450,574, filed Dec. 16, 1982, and now abandoned, and incorporates by reference the disclosure set forth in that application which is assigned to the assignee of the present application.

BACKGROUND OF THE INVENTION

1. Field Of The Invention

This invention relates to cooperative lensing electrode structures for cathode ray tubes, and more particularly to improved lensing means in plural beam in-line CRT electron gun assemblies wherein large lenses are achieved by the formation of cooperating discretely shaped apertures in two adjacent electrodes to provide small well-defined beam spot landings on the screen.

2. Description Of The Prior Art

The advancing state of the art in cathode ray tube technology has progressed hand-in-hand with the achievement of associated fabrication refinements and modifications that heretofore were considered impossible to effect. With improved efficiencies and capabilities have come tube design changes and a trend toward miniaturization and compaction of electron gun structures. These smaller gun structures are, in turn, encompassed within envelope neck portions of smaller dimensions and shorter lengths. Tube necks of 29 mm diameters, once considered small, are in the present state of the art accepted as regular neck sizes, as compared to the new "mini-neck" 22.8 mm diameters (17.5 mm I.D.). Consequently, the structural dimensions of the electrode elements in the respective gun assemblies have been adapted to achieve the desired compaction. Such is especially evident in color tube in-line gun assemblies, wherein three separate electron beams emanate in a substantially common plane. The desired compaction is conventionally achieved by employing unitized gun constructions embodying the combination of several functionally similar electrodes into single unitized structures.

In effecting miniaturization of in-line gun assemblies, factors influencing the quality of focusing (herein "lensing") of the individual electron beams become more critical as the diameters of the lenses, being positioned in-line in the horizontal plane of the assembly, are necessarily reduced to meet dimensional requirements.

The compaction of lenses and thus beam spacings in small gun assemblies tends to foster increased spherical aberration in the lenses. Thus, it becomes much more difficult to achieve the quality of beam focusing needed to produce the desired small and round spot of beam impingement on the display screen.

To more fully utilize the limited apertural space available in the reduced electrodes, overlapping lenses have been introduced in the art. Examples of such lenses are disclosed by Donald L. Say in U.S. patent application Ser. No. 303,751, filed Sept. 21, 1981, now U.S. Pat. No. 4,412,149, and by Ashizaki, Muranishi, and Sugahara in U.S. Pat. No. 4,275,332. The electrode structures of these teachings incorporate the inclusion of extra elements therein, such as discretely positioned wall inserts or U-shaped partition members.

To differentiate therefrom, objectives of the present invention include achieving improved lensing by making modifications to the apertures in the in-line beam lensing means to maximize lens dimensions in the limited available apertural regions without the addition of extra structural elements. A further objective resultant therefrom is the realization of much improved resolution evidenced in small and well defined beam spot landings that are substantially free of astigmatism. Such improvements are greatly desired in the advancing state of the art.

SUMMARY OF THE INVENTION

The invention pertains to improved electron beam lensing means in a plural beam color CRT in-line electron gun assembly having a center and two side-related integrated gun structures. Contained therein is a unitized low potential lensing electrode evidencing three in-line apertures, and associated therewith is an adjacent forwardly-related unitized high potential lensing electrode having a like number of rear-oriented in-line apertures therein. The lensing means of the invention relates to cooperative structural modifications made in each of the mentioned unitized electrodes to effect maximum sized lenses therebetween, such being advantageous in forming the respective electron beams to result in small sized round landing areas on the screen. Such landing areas have been very difficult to achieve in small compact gun structures.

State-of-the-art electrode apertures are conventionally substantially round straight-through openings having uniform dimension therethrough, but in accordance with the concept of the present invention, the in-line apertures in the front surface of the low potential lensing electrode member are formed as substantially tapered truncated volumetric geometrical figures featuring substantially sloped sidewalls evidencing larger frontal and smaller rearward openings. The larger frontal openings are resultants of delineations of the forward openings of three in-line oriented and rearwardly extending volumetric geometrical figures of construction having a common plane therethrough corresponding to the front surface of the electrode. The rearward openings of the tapered apertures, being formed as three smaller-dimensioned individual openings at a plane of truncation substantially parallel to the first plane, evidence separating sidewall interstitial webbings therebetween.

To aid in clarifying the description of the invention, definitions of certain terms are herewith presented. The notation "volumetric geometrical figures" is intended to include open figures featuring substantially sloped sidewalls. Such figures being preferably either substantially hemispherical or substantially conical in shaping. In keeping therewith, the term "tapered" is intended to include both linear and/or arcuate slopings of the inner sidewall surfaces of the respective aforementioned figures. Additionally, the designation "plane of truncation" denotes a plane parallel with the surface openings of the electrode, such plane being oriented to cut across the aforedescribed in-line positioned geometrical figures in a manner to separate the basal and terminal portions thereof, whereupon the resulting open basal truncations of the figures form the tapered apertures of the invention.

The adjacently associated and forwardly positioned high potential lensing electrode also evidences substantially inwardly sloping apertures, but oriented in a reverse manner to the low potential electrode, having smaller forward and larger aft openings. The tapered apertures formed in this electrode exhibit slightly greater dimensions than those in the low potential electrode. The aft openings, facing the low potential electrode, are resultants of delineations of the rearward openings of three in-line oriented and forwardly extending open volumetric geometrical figures of construction having a common plane therethrough. The forward openings of these tapered apertures are formed at a parallel plane of truncation and likewise evidence sidewall interstitial webbings therebetween.

Being so formed, the greater dimensioned tapered apertures of the high potential lensing electrode are spatially positioned to face the smaller dimensioned but similar tapered apertures of the low potential lensing electrode to enable large lenses to be formed in the conjunctive augmented spacings therebetween.

To advantageously utilize the limited lateral spacing afforded in compacted electron gun assemblies, the concept of the invention further provides for discrete partial overlapping of the three tapered in-line apertures in both the low and high potential lensing electrodes. The overlapping aperture feature enables the beneficial formation of still larger lenses of maximum dimensions for given electrode areas.

In this further modification, the partially overlapping forward openings of the three in-line oriented volumetric geometrical figures relating to the low potential lensing electrode trace two regions of overlap in the plane of the front surface of the electrode. Bisection of these regions of overlap by parallel planes of geometric section oriented normal to the in-line plane of the apertures provides substantially defined curvatures of intersection between the contiguous figures, and corresponding discontinuities in the peripheries of the respective frontal openings of the low potential electrode. The curvatures of intersection effect two parallel and arcuately contoured sidewall sections which recede into the tapered sidewalls of the low potential electrode apertures along the mentioned planes of geometric section. Since the overlap of contiguous figures does not extend to the plane of truncation, the rearward openings of the respective tapered apertures are individually defined openings separated by interstitial webbings.

The tapered apertures of the adjacent high potential lensing electrode, being partially overlapped in a similar and compatible manner, are likewise formed to have arcuately contoured sidewall sections receding into the tapered sidewalls thereof. And, in reverse manner to the low potential electrode, the forward openings of the apertures evidence individually defined openings separated by interstitial webbings.

The tapered aperture concept, as conjunctively utilized in the described embodiments of adjacently-positioned low and high potential beam lensing electrodes embodies either substantially linear tapered conical or substantially arcuately tapered hemispherical volumetric delineations, and as such is adaptable for broad usage in a number of electron gun structures. For example, it can be advantageously employed in multi-stage lense assemblies, such as those encountered in Hi-Bi-potential, Uni-Bi-potential, Bi-Uni potential, and Tri-potential gun assemblies. The combination of the invention is particularly beneficial in achieving desired beam focusing in Hi-Bi and Uni-Bi guns wherein the low and high potential electrodes are the respective main focusing and final accelerating electrodes in the assemblies.

The aforedescribed electrodes, embodying the discretely formed tapered apertures, are preferably formed as one-piece elements, being complete without the inclusion of added structures. To assure individually defined apertures at the respective planes of truncation, relatively short contiguous ring-like strengthening formations are preferably integrally formed as extensions of the aperture openings.

DESCRIPTION OF THE PREFERRED EMBODIMENT

For a fuller understanding of the present invention, together with other and further objects, advantages and capabilities thereof, reference is made to the following disclosure and appended claims in conjunction with the accompanying drawings.

Figure 1:
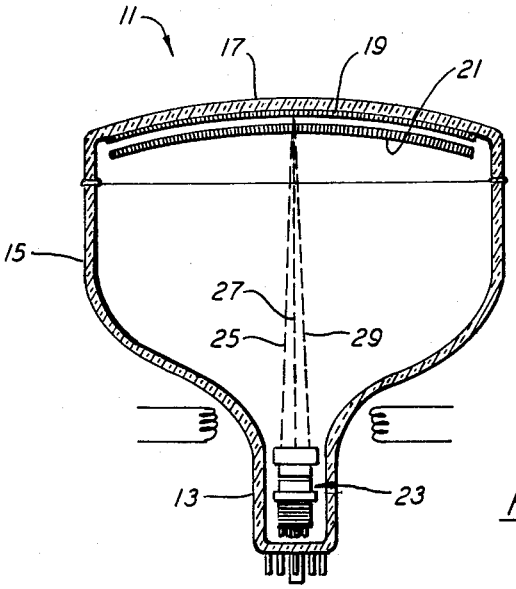
FIG. 1 is a sectioned elevation of a color cathode ray tube wherein the invention is employed.

With reference to FIG. 1 of the drawings, there is shown a color cathode ray tube (CRT) 11 of the type employing a plural beam in-line electron gun assembly. The envelope enclosure is comprised of an integration of neck 13, funnel 15 and face panel 17 portions. Disposed on the interior surface of the face panel is a patterned cathodoluminescent screen 19 formed as a repetitive array of color-emitting phosphor components in keeping with the state of the art. A multi-opening structure 21, such as a shadow mask, is positioned within the face panel in spatial relationship to the patterned screen.

Positionally encompassed within the envelope neck portion 13, is a unitized, plural beam in-line electron gun assembly 23, comprised of an integration of three side-by-side gun structures. Emanating therefrom are three separate electron beams 25, 27, and 29 which are directed to discretely impinge upon the patterned screen 19. It is within this electron gun assembly 23 that the improvement of the invention resides.

Specifically, the invention pertains to modification of the apertures in the low and high potential lensing electrodes of the gun assembly 23. For purposes of illustration, the invention will be described henceforth herein as relating to usage in a Uni-Bi gun structure 23, partially shown in FIG. 2, wherein the low potential lensing electrode will be the main focusing electrode 31, and the adjacent high potential lensing electrode will become the final accelerating electrode 33. Terminally positioned on the final accelerating electrode is a state-of-the-art plural apertured convergence cup-like member 35. The several unitized electrodes comprising the gun assembly 23 are conventionally positioned and held in spaced relationship by a plurality of insulative support rods, not shown.

Figure 2:
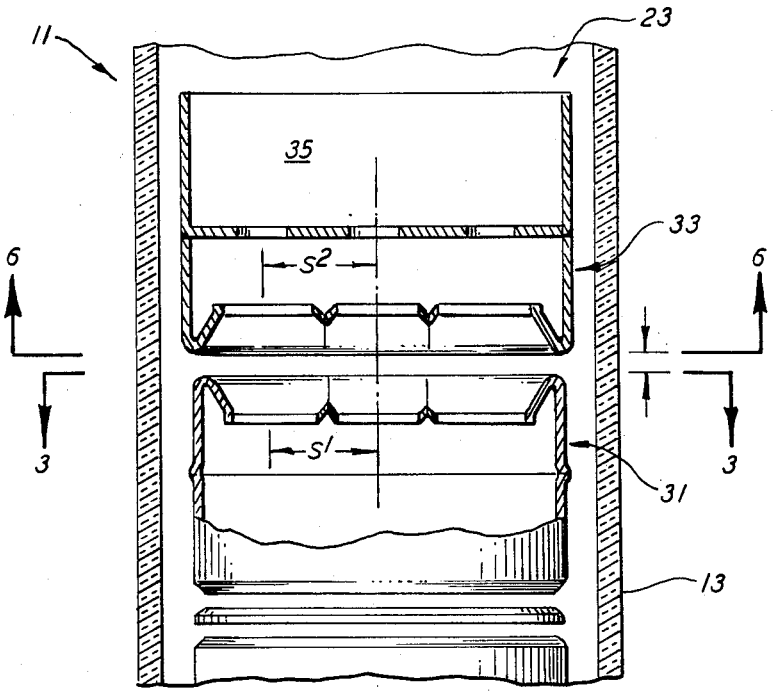
FIG. 2 is a sectioned view of the forward portion of the in-line plural beam electron gun assembly shown in FIG. 1, such view being taken along the in-line plane thereof in a manner to illustrate one embodiment of the invention.
Figure 9:
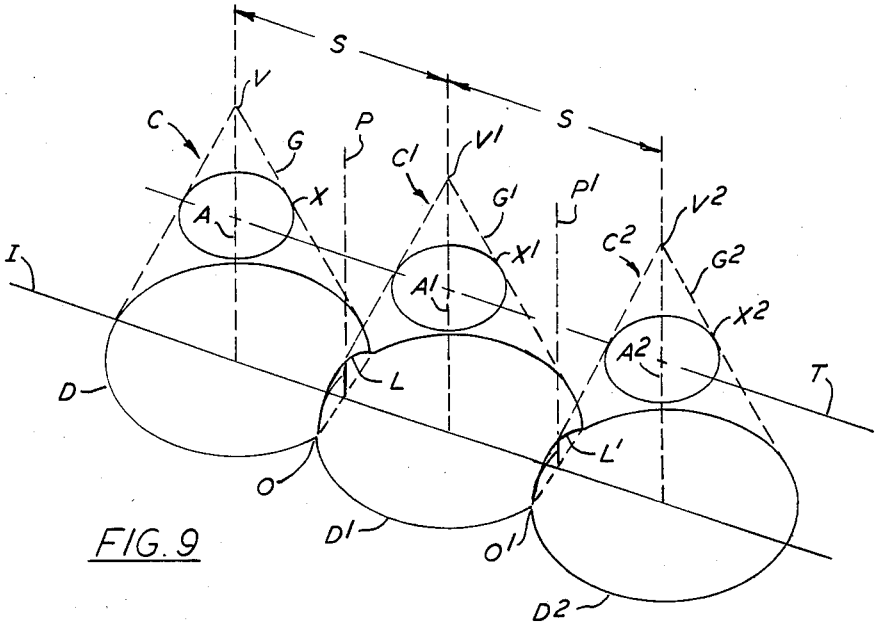
FIG. 9 is an isometric view illustrating the partially overlapping cones of construction basic to the formation of the tapered apertures.

The structural aspects of the invention relate to modifications of the apertures in both the main focusing electrode 31 and the spatially associated final accelerating electrode 33 since they work conjunctively to form the important final part of a distributed lensing system. The positional relationship of the two cooperating electrodes, as illustrated in the embodiment shown in FIG. 2, shows each as having substantially linear tapered apertures, which by way of example are in partially overlapping relationship to attain maximum sized apertures in the limited lateral space available. FIG. 9 illustrates the relationship of three basic open volumetric geometrical figures formed as cones of construction C, $C^1$ and $C^2$ whereof the parameters apply to the general formation of one embodiment of the respective apertures in each electrode.

In considering this first embodiment in greater detail, reference is directed to FIGS. 3, 4, 5, and 9 wherein modifications of the (low potential) main focusing electrode 31 are delineated. Each of the three in-line partially overlapping linear tapered apertures 37, 39, and 41 of this electrode have sloped sidewalls 43, 45 and 47 with frontal openings 49, 51, and 53, and rearward openings 55, 57 and 59 with separate axes 61, 63 and 65 therethrough.

Figure 3:
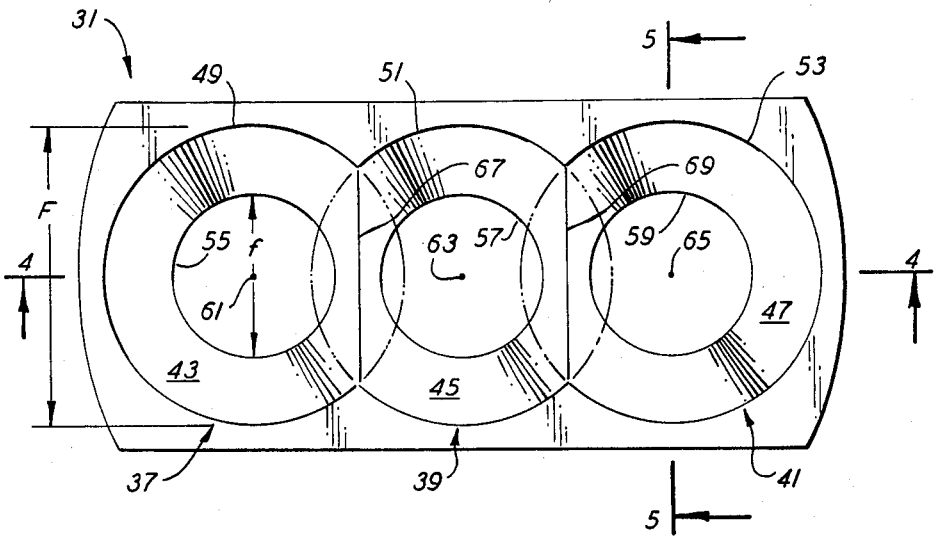
FIG. 3 is a plan view of only the unitized low potential lensing electrode of the gun assembly taken along the plane of 3—3 in FIG. 2.
Figure 4:
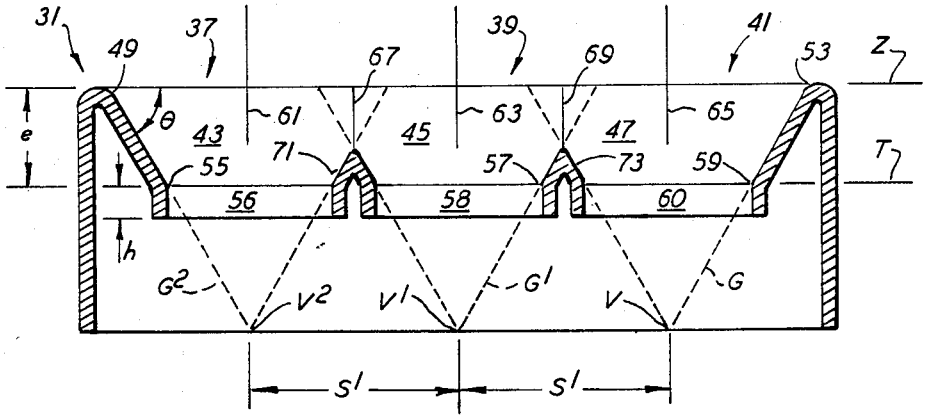
FIG. 4 is a sectioned elevational view of the low potential electrode taken along the in-line plane 4—4 in FIG. 3.
Figure 5:
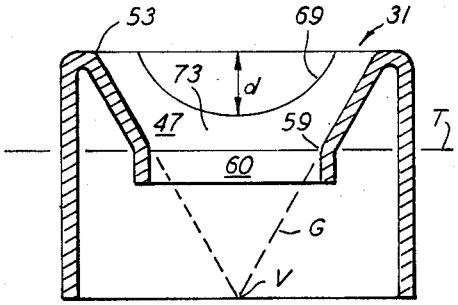
FIG. 5 is a sectioned elevational view of the low potential electrode taken along the plane 5—5 in FIG. 3.

As shown, particularly in FIGS. 4, 5, and 9 the overlapping frontal openings 49, 51, and 53 of the apertures are the resultants of the delineations of the partially overlapping directrices D, $D^1$, and $D^2$ of three in-line oriented and rearwardly extending cones. Such are exemplified in FIG. 9 by cones of construction C, $C^1$, and $C^2$, whereof each has a respective vertex V, $V^1$, and $V^2$ wherefrom generatrices G, $G^1$ and $G^2$ delineate the directrices D, $D^1$, and $D^2$, thereby defining the frontal openings. Bisections of the two regions of conic overlap O and $O^1$ by two similar planes of conic section P and $P^1$ oriented parallel with the axes A, $A^1$, and $A^2$ and normal to the in-line plane I; and the elimination of the overlappings along the planes of geometric section P and $P^1$ provides two arcuate lines of intersection L and $L^1$ which are substantially hyperbolic in contour. The elimination of the overlapping material effects discontinuities in the peripheries of the respective overlapped directrices, and the resultant frontal openings 49, 51, and 53 are shown in FIG. 3 wherein the regions of overlap are designated by broken lines. The definitive lines of conic construction, as denoted in FIG. 9 are phantomed in FIGS. 4 and 5 to clarify structure.

The arcuate lines of intersection L and $L^1$ effect two like parallel and arcuately contoured tapered sidewall sections 67 and 69 along the respective planes of geometric section. One of the hyperbolic contoured sections 67 recedes into the intersection of the tapered sidewalls 43 and 45 of apertures 37 and 39, while the other hyperbolic defined section 69 recedes in like manner into the intersection of the tapered sidewalls 45 and 47 of apertures 39 and 41. The depths of these like hyperbolic formations are designated as d in FIG. 5.

The three rearward openings 55, 57, and 59 of the apertures, being of lesser dimensions than the corresponding frontal openings, are defined as separate and substantially symmetrical openings evidencing interstitial sidewall webbings 71 and 73 therebetween. These three rearward openings are delineated in FIG. 9 as X, $X^1$, and $X^2$, such being formed by a plane of truncation T, which being parallel to the in-line plane I, cuts the cones beyond the regions of overlap thereby producing the truncated cones or tapered apertures.

Figure 6:
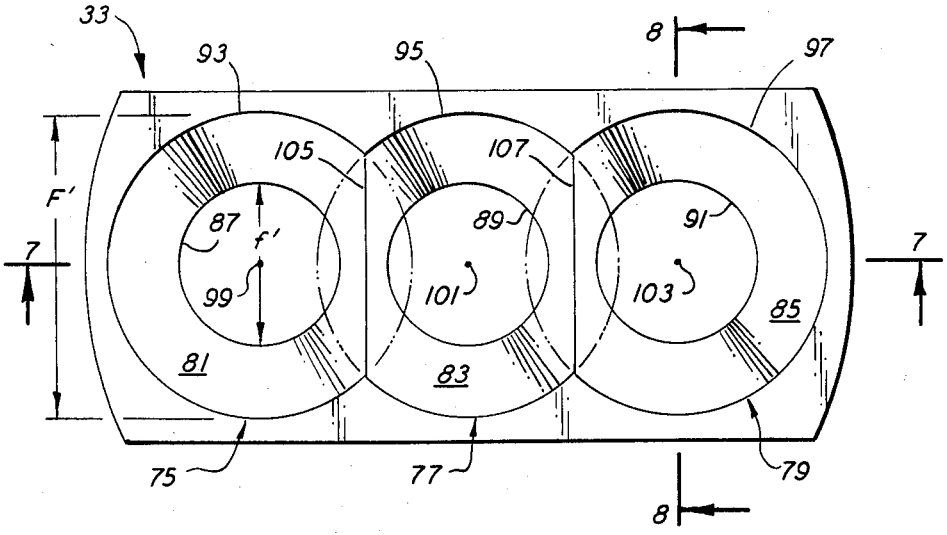
FIG. 6 is a plan view of only the unitized high potential lensing electrode of the gun assembly taken along the plane 6—6 in FIG. 2.

The structural modifications of the (high potential) final accelerating electrode 33 are of a form similar to but reversed from those already described for the main focusing electrode. With reference to FIGS. 6, 7, 8, and 9, the three in-line partially overlapping tapered apertures 75, 77, and 79 have sloped sidewalls 81, 83, and 85 with forward openings 87, 89, and 91, and greater dimensioned aft openings 93, 95, and 97 with separate axes 99, 101, and 103 therethrough. The overlapping aft openings of the apertures as denoted in FIG. 6 are the resultants of the delineations of the partially overlapping directrices D, $D^1$, and $D^2$ of the overlapping cones of construction C, $C^1$, and $C^2$, as shown in FIG. 9. The described bisection and elimination of the overlapped conical material effects two like parallel and arcuately contoured tapered sidewall sections 105 and 107. One of these hyperbolic contoured sections 105 recedes into the intersection of the tapered sidewalls 81 and 83 of the apertures 75 and 77, while the other hyperbolic defined section 107 recedes in like manner into the intersection of the tapered sidewalls 83 and 85 of the apertures 77 and 79. The depths of these like hyperbolic formations are denoted as $d^1$ in FIG. 8. The definitive lines of conic construction, as denoted in FIG. 9, are also phantomed in FIGS. 7 and 8 to clarify structure.

The three forward openings 87, 89, and 91 of the apertures, being of lesser dimensions than the corresponding aft openings, are defined as separate and substantially symmetrical openings evidencing interstitial sidewall webbings 109 and 111 therebetween. As previously described, these aft openings are delineated in FIG. 9 as X, $X^1$, and $X^2$ by the plane of truncation T, which cuts the cones beyond the regions of overlap thereby effecting the truncated cones or tapered apertures 75, 77, and 79.

Figure 7:
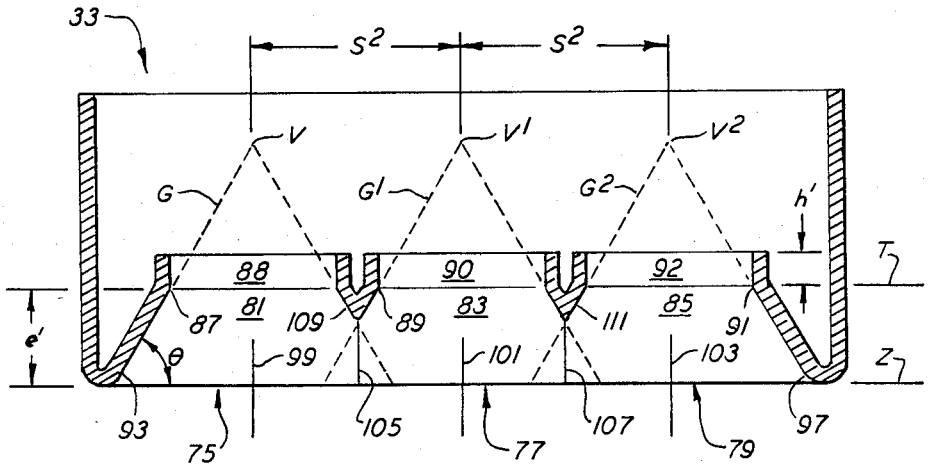
FIG. 7 is a sectioned elevational view of the high potential electrode taken along the in-line plane 7—7 in FIG. 6.

As shown in FIGS. 4 and 7, the tapered apertures in both electrodes evidence angles of taper $\angle\theta$ that are substantially within the range of 50 to 70 degrees with the plane of aperture Z. Such is determined by the size of openings desired at the plane of truncation T, and by the amount of sidewall interstitial webbing required to maintain consistent apertural openings thereat. These considerations also determine aperture depths e and $e^1$. In the examples shown, the conically tapered apertures in both the main focusing and the final accelerating electrodes evidence substantially similar angles of taper, but such is not to be considered limiting.

As illustrated in FIGS. 4 and 5, the rearward openings 55, 57 and 59 of the conically tapered apertures in the main focusing electrode 31 evidence relatively short contiguous open ring-like formations 56, 58, and 60 which project rearward therefrom as substantially like internally-dimensioned aperture-defining and strengthening extensions thereof. Similarly, the forward openings 87, 89, and 91 of the tapered apertures in the final accelerating electrode 33 likewise evidence relatively short contiguous open ring-like formations 88, 90, and 92 which project forward therefrom as substantially like internally-dimensioned aperture-defining and strengthening extensions thereof. In the respective electrodes these extensions exhibit heights of h and $h^1$.

The final lensing of each of the electron beams is accomplished as shown in FIG. 2, by the larger-than-usual lenses formed interspatially between the main focusing electrode 31 and the final accelerating electrode 33; the influencing fields of which extend into the opposed cavities of the respective facially-oriented tapered apertures. Thus, these conically tapered partially overlapping apertures effect maximum utilization of the respective electrode areas available. For example, in a typical mini-neck main focusing electrode, the open aperture size can be increased from a normal diameter of substantially 0.140 inch (3.55 mm) to a beneficially larger diameter of substantially 0.220 inch (5.588 mm). Dimensional changes of this sort are quite significant in small compacted CRT electron gun assemblies. It has been found that utilization of tapered overlapping apertures in the final accelerating electrode, that are of slightly larger dimensions than the similarly shaped apertures in the main focusing electrode results in the formation of lenses exhibiting significantly superior lensing characteristics. Such lensing provides a marked improvement (typically approximately a 25 percent reduction) in the size of beam spot landings in comparison with those realized by conventional straight-through electrode apertures.

An exemplary usage of the invention is presented as employed in a mini-neck gun assembly. The inter-electrode spacing between the low potential main focusing electrode 31 and the high potential final accelerating electrode 33 is substantially 0.040 inch (1.016 mm). The main focusing electrode potential is substantially within the range of 25 to 35 percent of the final accelerating electrode potential. In this instance, the angle of taper $\angle\theta$ in the frustum-like apertures of both electrodes is substantially 60°. Exemplary apertural dimensions are substantially as follows:

| | Dimensions in the order of: |
|---|---|
| Final Accelerating Electrode (33) | |
| Beam Spacings ($S^2$) center-to-center | 0.182 inch (4.623 mm) |
| Dia. ($F^1$) of Aft Openings (93, 95 and 97) | 0.250 inch (6.350 mm) |
| Dia. ($f^1$) of Forward Openings (87, 89 and 91) | 0.150 inch (3.810 mm) |
| *Depth ($d^1$) of Hyperbolic Intersections (105 and 107) | 0.059 inch (1.499 mm) |
| Main Focusing Electrode (31) | |
| Beam Spacings ($S^1$) center-to-center | 0.177 inch (1.956 mm) |
| Dia. (F) of Frontal Openings (45, 51, and 53) | 0.220 inch (5.588 mm) |
| Dia. (f) of Rearward Openings (55, 57, and 59) | 0.140 inch (3.556 mm) |
| *Depth (d) of Hyperbolic Intersections (67 and 69) | 0.037 inch (0.940 mm) |

*The depths d and $d^1$ of the respective hyperbolic intersections d (67 and 69) and $d^1$ (105 and 107) are calculated as follows:

$$\frac{\frac{F^1 - S^1}{2}}{\text{tang. of } 30^\circ} = d^1 \qquad \frac{\frac{F - S}{2}}{\text{tang. of } 30^\circ} = d$$

It is to be understood that the foregoing exemplary dimensions are not to be considered limiting to the concept of the invention.

Figure 13:
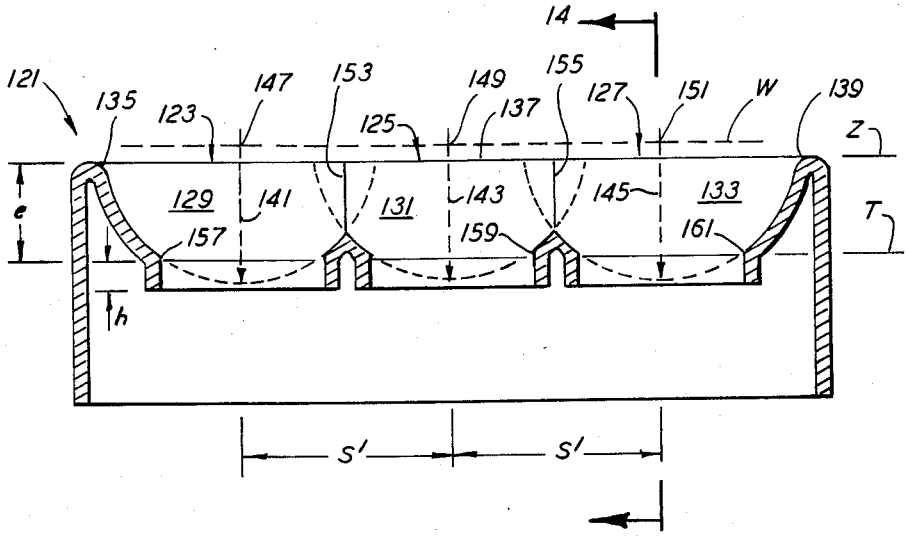
FIG. 13 illustrates another embodiment of the invention, such being a sectioned elevational view of the low potential electrode taken, for example, along the in-line plane 4—4 in FIG. 3.
Figure 14:
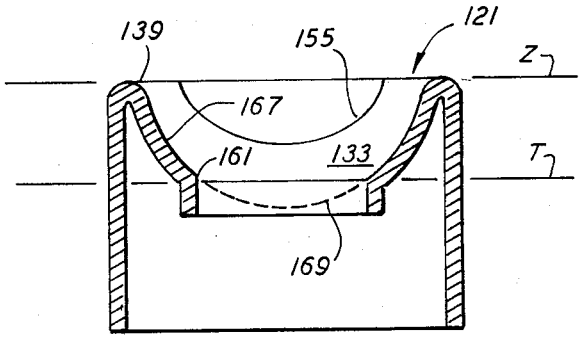
FIG. 14 is a sectioned elevational view of the low potential electrode taken along the plane 14—14 in FIG. 13.

Another embodiment of the invention, as shown in FIGS. 13 and 14, relates for example to a (low potential) main focusing in-line electrode 121 wherein arcuately tapered apertures are incorporated. Each of the three partially overlapping apertures 123, 125, and 127 of this embodiment evidences arcuately sloped sidewalls 129, 131, and 133 with frontal openings 135, 137, and 139, and rearward openings 157, 159, and 161. The frontal view into the plane of apertures Z is similar to that of the first embodiment as evidenced in FIG. 3. The tapers of the curved or arcuate sidewalls of the apertures 123, 125, and 127 are resultants of partially overlapping substantially hemispherical geometrical figures of construction, such being formed by individual radii 141, 143, and 145 emanating from respective centers 147, 149, and 151 located in common plane W. As exemplarily shown, common plane W is parallel with and slightly removed from the plane of apertures Z, such being in the order of 0.015–0.025 inch (0.38–0.64 mm). But, such is not to be considered limiting, as in certain instances, the two planes may be substantially coincident.

The overlapping of the in-line hemispherical figures provides two like parallel and arcuately contoured tapered sidewall sections 153 and 155 along the respective planes of geometric section, such intersection being substantially semi-circular in contour as shown by notation 155 in FIG. 14.

The three rearward openings 157, 159, and 161 of the apertures, being of lesser dimensions than the corresponding frontal openings, are defined as separate and substantially symmetrical openings evidencing interstitial sidewall webbings 163 and 165 therebetween. These three rearward openings are formed by the plane of truncation T which, being parallel to the in-line plane of apertures Z, cuts each of the substantially hemispherical figures beyond the regions of overlap, thereby separating each figure into a utilized basal truncated portion 167 and a discarded terminal portion 169. Thus, the resultant truncated portions form the respective curved-surface apertures of the electrode.

In the first described embodiments of the invention, the apertural modifications of the associated (high potential) final accelerating electrode were formed similarly to those evidenced in the main focusing electrode. Likewise, in this embodiment the apertures in final accelerating electrode are of partial hemispherical delineations but reversed from those described for the main focusing electrode. Since the description for the first embodiment states the general thesis of the relationship between the associated focusing and accelerating electrodes, along with exemplary dimensions thereof, further description is not deemed necessary herewith.

In both embodiments, the electrode members per se are fabricated, for example, as one-piece elements, being drawn from sheet material of substantially 8 to 15 mil thickness. Suitable material is the 300 Series of stainless steel, whereof Type 305 is particularly well suited for drawing applications.

In the above described embodiments, the respective aperture shaping delineations, resultant of geometrical figures in the form of either substantially linear tapered conical or arcuate tapered substantially hemispherical truncated manifestations, expeditiously effect conjunctive inter-electrode spatial volumes necessary to adequately accommodate the formation of desirably large focusing lenses. In addition, partial overlapping of the geometrical figures of construction beneficially maximizes the respective lensing areas.

Figure 10:
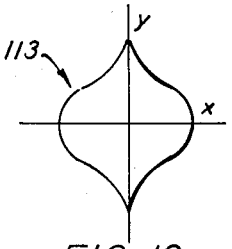
FIGS. 10, 11, and 12 are planar views illustrating focused beam spot landings on the screen of the tube.
Figure 12:
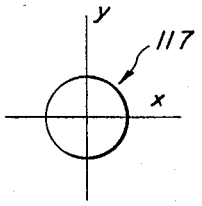
Figure 11:
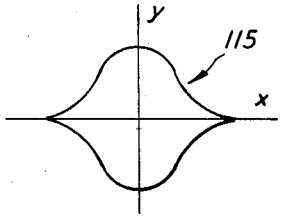
Figure 8:
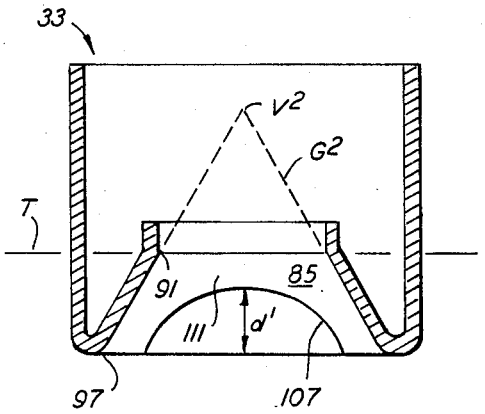
FIG. 8 is a sectioned elevational view of the high potential electrode taken along the plane 8—8 in FIG. 6.

Inclusion of the conjunctive apertural modifications in both of the electrodes which generate the final lenses, as described, provides small beam spot landings heretofore not attained. If the tapered overlapping apertures were incorporated in only the main focusing electrode, smaller than normal spot sizes would be realized, but they would tend to exhibit horizontally oriented oval shapings 113 somewhat as generalized in FIG. 10. Counter thereto, if the apertural modifications were effected in only the final accelerating electrode, the defined spots would tend to be vertically oriented oval shapings 115 somewhat as shown in FIG. 11. However, when the tapered apertures are employed as cooperating structures in both electrodes as described, the resultant spot landings are small, substantially round and well defined formations 117 substantially free of asigmatic influence as illustrated in FIG. 12.

While there have been shown and described what are at present considered to be the preferred embodiments of the invention, it will be obvious to those skilled in the art that various changes and modifications may be made therein without departing from the scope of the invention as defined in the appended claims.

For example, while substantially conically and spherically tapered apertural sidewall embodiments have been shown and described herein, the concept of the invention is intended to have sufficient breadth to also include other apertural sidewall tapers such as, hyperboloidal, paraboloidal, ovoidal, either concave or convex, and combinations thereof. Furthermore, it is not necessary that all apertures in the respective electrodes be of the same shapings.

I claim:

1. In an in-line electron gun structure for a color cathode ray tube, a lensing arrangement in the final low potential lensing and high potential lensing electrodes comprising:

a first lensing structure in the forward portion of the low potential lensing electrode, such structure having three in-line linearly tapered apertures of substantially truncated volumetric configuration, each aperture having beam-exiting front and smaller dimensioned beam-entering rear openings, the front and rear openings being connected by sloping sidewalls; and a second lensing structure in the rear portion of the high potential lensing electrode in adjacent, facing relationship with the first structure, such second structure having three in-line linearly tapered apertures of substantially truncated volumetric configuration, each aperture having beam-entering rear and smaller dimensioned beam-exiting front openings, the front and rear openings being connected by sloping sidewalls.

2. The in-line electron gun structure of claim 1 wherein said low potential lensing electrode is the main beam focusing electrode, and said high potential lensing electrode is the final beam accelerating electrode.

3. The in-line electron gun structure of claim 1 wherein said tapered apertures in said high potential lensing electrode have front and rear openings that are dimensionally greater than the respective rear and front openings of the tapered apertures in said adjacent low potential lensing electrode.

4. The in-line electron gun structure of claim 1 wherein the rear openings of said tapered apertures in said low potential lensing electrode terminate in relatively short ring-like aperture extensions.

5. The in-line electron gun structure of claim 1 wherein the front openings of said tapered apertures in said high potential lensing electrode terminate in relatively short ring-like aperture extensions.

6. The in-line electron gun structure of claim 1 wherein the linear taper defines a truncated conical configuration.

7. The in-line electron gun structure of claim 1 wherein the first lensing structure has a linear taper forming an angle with the front opening plane substantially within the range of 50 to 70 degrees.

8. The in-line electron gun structure of claim 1 wherein the second lensing structure has a linear taper forming an angle with the rear opening plane substantially within the range of 50 to 70 degrees.

9. In an in-line electron gun structure for a color cathode ray tube, a lensing arrangement in the final low potential lensing and high potential lensing electrodes comprising:

a first lensing structure in the forward portion of the low potential lensing electrode, such structure having three in-line tapered apertures of substantially truncated spherical configuration, each aperture having beam-exiting front and smaller dimensioned beam-entering rear openings, the front and rear openings being connected by sloping sidewalls; and a second lensing structure in the rear portion of the high potential lensing electrode in adjacent, facing relationship with the first structure, such second structure having three in-line tapered apertures of substantially truncated spherical configuration, each aperture having beam-entering rear and smaller dimensioned beam-exiting front openings, the front and rear openings being connected by sloping sidewalls.

10. The in-line electron gun structure of claim 9 wherein said low potential lensing electrode is the main beam focusing electrode, and said high potential lensing electrode is the final beam accelerating electrode.

11. The in-line electron gun structure of claim 9 wherein said tapered apertures in said high potential lensing electrode have front and rear openings that are dimensionally greater than the respective rear and front openings of the tapered apertures in said adjacent low potential lensing electrode.

12. The in-line electron gun structure of claim 9 wherein the rear openings of said tapered apertures in said low potential lensing electrode terminate in relatively short ring-like aperture extensions.

13. The in-line electron gun structure of claim 9 wherein the front openings of said tapered apertures in said high potential lensing electrode terminate in relatively short ring-like aperture extensions.

14. In an in-line electron gun structure for a color cathode ray tube, a lensing arrangement in the final low potential lensing and high potential lensing electrodes comprising:

a first lensing structure in the forward portion of the low potential lensing electrode, such structure having three in-line linearly tapered apertures of substantially truncated volumetric configuration, each aperture having beam-exiting front and smaller dimensioned beam-entering rear openings, the front and rear openings being connected by sloping sidewalls, a portion of the sidewall of each aperture intersects with a portion of the sidewall of an adjacent aperture to form an inwardly sloping arcuate rounded saddle along the region of intersection, such structure resulting from the partial overlapping of geometric constructions of the volumetric configurations; and a second lensing structure in the rear portion of the high potential lensing electrode in adjacent, facing relationship with the first structure, such second structure having three in-line linearly tapered apertures of substantially truncated volumetric configuration, each aperture having beam-entering rear and smaller dimensioned beam-exiting front openings, the front and rear openings being connected by sloping sidewalls, a portion of the sidewall of each aperture intersects with a portion of the sidewall of an adjacent aperture to form an inwardly sloping arcuate rounded saddle along the region of intersection, such structures resulting from the partial overlapping of geometric constructions of the volumetric configurations.

15. The in-line electron gun structure of claim 14 wherein the aperture sidewalls in at least one of the lensing structures have a linear taper.

16. The in-line electron gun structure of claim 14 wherein the aperture sidewalls of at least one of said lensing structures have an arcuate taper.

17. The in-line electron structure of claim 16 wherein the arcuate taper defines a truncated spherical configuration.

18. The in-line electron gun structure of claim 14 wherein said low potential lensing electrode is the main beam focusing electrode, and said high potential lensing electrode is the final beam accelerating electrode.

19. The in-line electron gun structure of claim 14 wherein said tapered apertures in said high potential lensing electrode have front and rear openings that are dimensionally greater than the respective rear and front openings of the tapered apertures in said adjacent low potential lensing electrode.

20. The in-line electron gun structure of claim 14 wherein the rear openings of said tapered apertures in said low potential lensing electrode terminate in relatively short ring-like aperture extensions.

21. The in-line electron gun structure of claim 14 wherein the front openings of said tapered apertures in said high potential lensing electrode terminate in relatively short ring-like aperture extensions.

22. The in-line electron gun structure of claim 14 wherein the linear taper defines a truncated conical configuration.

23. The in-line electron gun structure of claim 14 wherein the first lensing structure has a linear taper forming an angle with the front opening plane substantially within the range of 50 to 70 degrees.

24. The in-line electron gun structure of claim 14 wherein the second lensing structure has a linear taper forming an angle with the rear opening plane substantially within the range of 50 to 70 degrees.

* * * * *